United States Patent [19]

Hessey

[11] Patent Number: 4,871,115

[45] Date of Patent: Oct. 3, 1989

[54] SMOKE GENERATING APPARATUS

[76] Inventor: B. Russell Hessey, 3533 Legendary Dr., Las Vegas, Nev. 89121

[21] Appl. No.: 88,375

[22] Filed: Aug. 24, 1987

[51] Int. Cl.[4] ..... B05B 1/24

[52] U.S. Cl. ..... 239/136; 239/133; 219/273; 219/275

[58] Field of Search ..... 239/133, 135, 136, 114, 239/115, 116; 219/271, 272, 273, 275

[56] References Cited

U.S. PATENT DOCUMENTS

| | | | |
|---|---|---|---|
| 1,882,241 | 10/1932 | Curran | 239/114 |
| 2,294,578 | 9/1942 | Shapiro et al. | 219/273 |
| 2,316,887 | 4/1943 | Pate et al. | 239/116 |
| 3,458,948 | 8/1969 | Curtis et al. | 219/275 |
| 3,969,842 | 7/1976 | Velie | 239/136 |
| 4,255,646 | 3/1981 | Dragoy et al. | 222/3 |
| 4,297,563 | 10/1981 | Berry | 219/275 |
| 4,480,172 | 10/1984 | Ciciliot | 239/135 |

*Primary Examiner*—Andres Kashnikow
*Assistant Examiner*—Christopher G. Trainor
*Attorney, Agent, or Firm*—Edward J. Quirk

[57] ABSTRACT

A portable smoke-generating apparatus particularly useful for creating special effects in the film-making and entertainment industry has a vaporizing unit consisting of a solid metallic block having an elongate interior vaporizing chamber. A solid metallic vaporizing member having a cross-sectional configuration corresponding to the cross-sectional configuration of the vaporizing chamber is loosely mounted in the chamber. The passageway between the interior walls of the vaporizing chamber and the exterior walls of the vaporizing element provides a very narrow conduit having a very very high surface area/volume ratio of at least 500, and preferably at least 1,000, to ensure rapid complete vaporization of the liquid and production of a white, dry smoke having a very small particle size. Heat is supplied to the vaporizing chamber by either electrical resistance heaters or a combustions torch mounted in one or more designated chambers in the block. Use of a nozzle having an orifice with a diameter of 0.35–0.80" provides flow of adequate volume while retaining sufficient back pressure in the vaporization chamber to provide a strong burst of smoke.

15 Claims, 4 Drawing Sheets

SMOKE GENERATING APPARATUS

BACKGROUND OF THE INVENTION

This invention relates to apparatus for generating smoke having precisely controllable quantities and qualities, especially for use in the movie and entertainment industry. More particularly, it relates to a portable smoke-generating device having a vaporizing chamber with a very high surface area/volume ratio.

Liquid vaporizers of various types have been used for many years for many purposes. For example, spraying of fertilizers and insecticides by pumping a liquid through a fine nozzle under high pressure is common practice. The generation of smoke in airplane exhausts for skywriting purposes, and for fire simulations for firefighters' training, is also well known. Since precision of control of smoke-generating units is generally not an important design criterion, commercial smoke-generating units generally consist of relatively simple units having vaporizing chambers capable of rapidly heating a smoke generating liquid to above its flash point, and a nozzle for directing the smoke produced in the device to the desired location. A typical smoke-generating device of this type is shown in Swiatosz, U.S. Pat. No. 4,303,397. This patent i discloses a portable smoke generator having a centrifugal pump which pumps a liquid through a tubular coil in which the liquid is vaporized for discharge through a nozzle. While this device is suitable for the purpose for which it was designed, i.e., to simulate a fire for training a student how to handle a fire, it is not adequate to produce smoke of sufficient quality and with sufficient flexibility to produce special effects for the motion picture industry.

The entertainment industry, and particularly the television and motion picture film industry, has continuous requirements for smoke generation for a wide variety of purposes and effects. In addition to creating the most obvious special effects in a film (e.g., the generation of smoke to simulate a fire), smoke-generating machines are used to help create hundreds of different special effects when filming. Smoke machines can be used to create the effect of fog, clouds, chimney smoke, discotheque haze, and to obscure background elements which are not desirably seen on film. Artistic effects, such as light "shafting", are also created by smoke. For example, if filming is being carried out in a large building or in a church, a film director may desire a very slight haze in the building so that light coming in through a window or skylight will appear on the film in visible "shafts". To create this effect without creating an appearance of an actual haze or fog requires extremely precise control over the amount and quality of smoke exhausted into the building.

Indeed, the use of smoke in filming is more commonly for artistic purposes than for the creating of the appearance of actual smoke. On film, smoke creates the impression of depth of field, whereas a camera itself has no depth of field. When using smoke during filming, the smoke must be created instantly (since it is important that high priced personnel not be idle waiting for a smoke generator to operate properly), and must mix with the air and stay suspended without changing consistency during the entire filming of a scene. Usually, filming intervals last about one minute, and then will be rerun several times. Accordingly, it is absolutely essential that the smoke maintain a perfect consistency for at least 10–20 minutes. Even prior to filming, it is essential that the f-stop on the camera be set accurately according to the lighting on the filming set. If smoke is to be used on the set, the camera must be set with the smoke in precisely the same color and density as will occur during the actual filming of a scene. The smoke produced during the camera setting session must be precisely reproducible during the filming. While the production of smoke for these purposes may appear to be a simple chore, in actuality it is a very difficult and somewhat artistic science.

Smoke also has many other unobvious uses during filming. For example, when filming period pictures (e.g., Civil War pictures, or other films set prior to the turn of the 20th century), certain background features of the landscape must be obscured for consistency with the time period being portrayed. Thus, antennas, power lines, towers, and even certain buildings must be eliminated from a scene. Normally, this is done by creating a smoke haze which obscures these features from the film. Smoke is also used to create a visible exhaust from cars, puffs from squealing tires, battlefield smoke, and for creation of visible smoke from a burning fire such as a kerosene lantern which would not otherwise be visible on film. The effect of swampy bogs for creature films, and tule fog, is created by producing smoke from a smoke generator and cooling the smoke by passing it through a dry ice chamber; the cooled smoke then settles to produce a heavy fog appearance. Small puffs of smoke may be created through chimney smokestacks or locomotive engines. Even the effect of steam from a stove top cookpot can be precisely controlled by generating a small amount of cooled smoke (as for the generation of tule fog) and placing the smoke on the surface of water in the pot; as the water heats up, the smoke warms and rises and is visible on film in a much more effective way than steam alone.

Accordingly, it is apparent that a smoke-generating machine for special effects has very particular requirements and criteria which must be met. The smoke produced must be white and completely dry, thus enabling it to hang in the air without visible change for 10–20 minutes, and must be non-toxic. The smoke-generating apparatus must be noiseless, and must be capable of generating the dry smoke instantly upon request and in accurately controllable quantities.

Applicant has developed a smoke-generating machine particularly useful for creating special effects and which satisfies all of the foregoing requirements. The machine is portable and consists of a pressurized smoke-generating-liquid holding tank, and a vaporizing chamber having a very high surface area/volume ratio. The vaporizing unit preferably consists of a hollow metal heated block having a vaporizing member loosely mounted within the chamber and configured such that a very narrow path is created for the liquid through the vaporizing chamber. The narrow path, and high surface/volume ratio in the chamber ensure instant and complete vaporization of the smoke-generating liquid. A very small smoke nozzle orifice creates a substantial back pressure in the vaporization chamber, producing a forceful stream of smoke through the nozzle.

Accordingly, it is an object of the present invention to provide a smoke-generating machine which is particularly useful for creating a large variety of special effects for the motion picture, television, and related industries. It is another object of the invention to provide a portable smoke generator which can produce completely dry, white smoke instantly upon demand, and with a minimum amount of noise. These and other purposes are accomplished by the smoke generator of the invention, an embodiment of which is disclosed herein.

BRIEF SUMMARY OF THE INVENTION

A special effects smoke generator has a housing upon which is mounted a pressurized tank for holding smoke-generating liquid. A vaporizer consists of a solid metallic base having an elongate interior vaporizing chamber which contains a solid vaporizing member mounted in the chamber. The cross-section of the vaporizing member approximates the cross-section of the vaporizing chamber, creating a narrow peripheral passageway around the vaporizing member as fluid traverses the chamber. Heat is supplied to the vaporizing means by an electrical resistance heater or combustion gases. Valves are provided in conduits which carry smoke-generating liquid from the tank to the vaporizing means to enable precise control of the quantities of liquid fed to the vaporizing means; these valves may be actuated either by a person carrying the machine or remotely.

BRIEF DESCRIPTION OF THE DRAWINGS

The invention is best understood with reference to the drawings, in which.

DETAILED DESCRIPTION OF A PREFERRED EMBODIMENT

Figure 1:
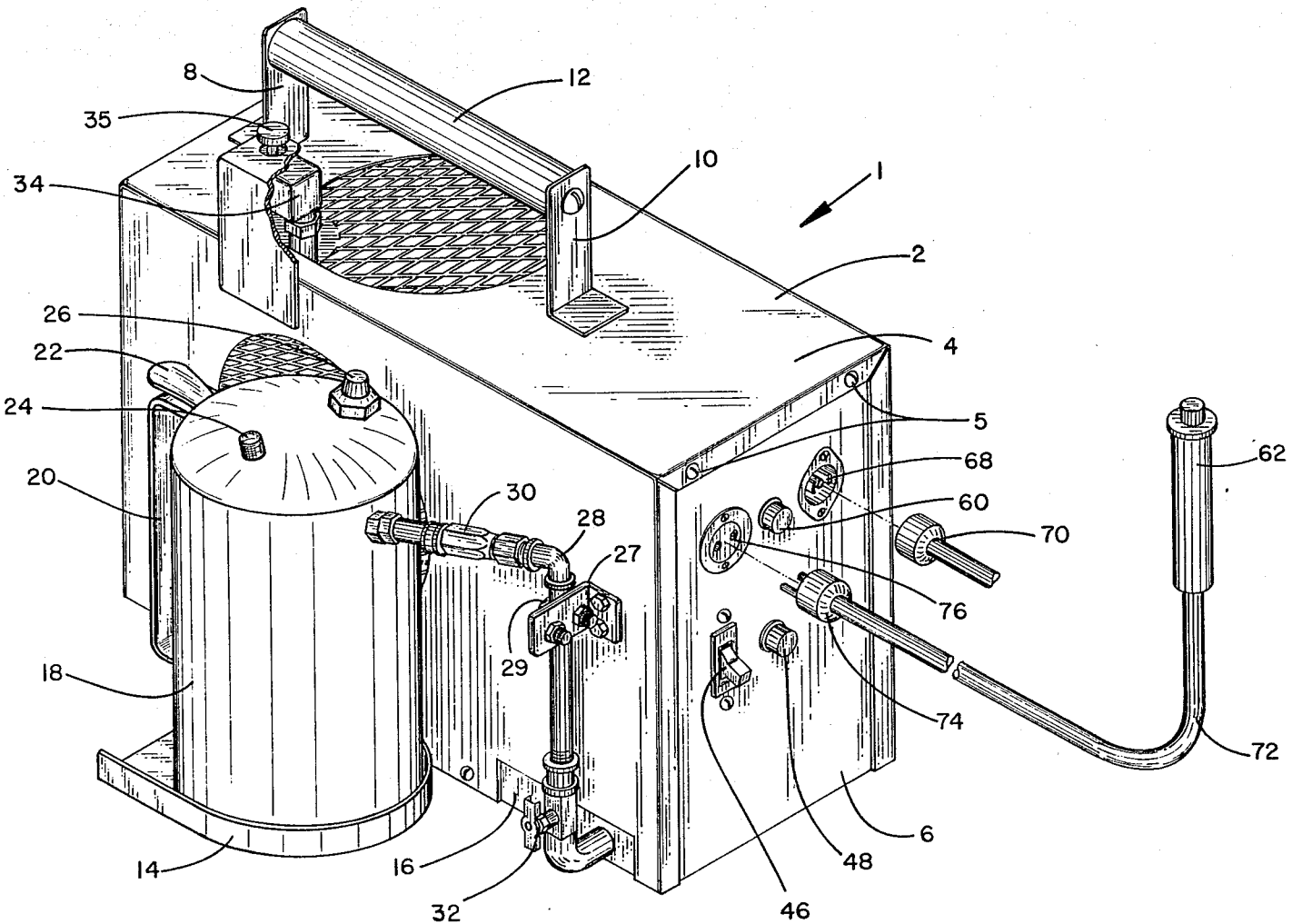
FIG. 1 is a perspective view of a smoke-generating apparatus of the invention showing the housing and exterior features thereof.
Figure 4:
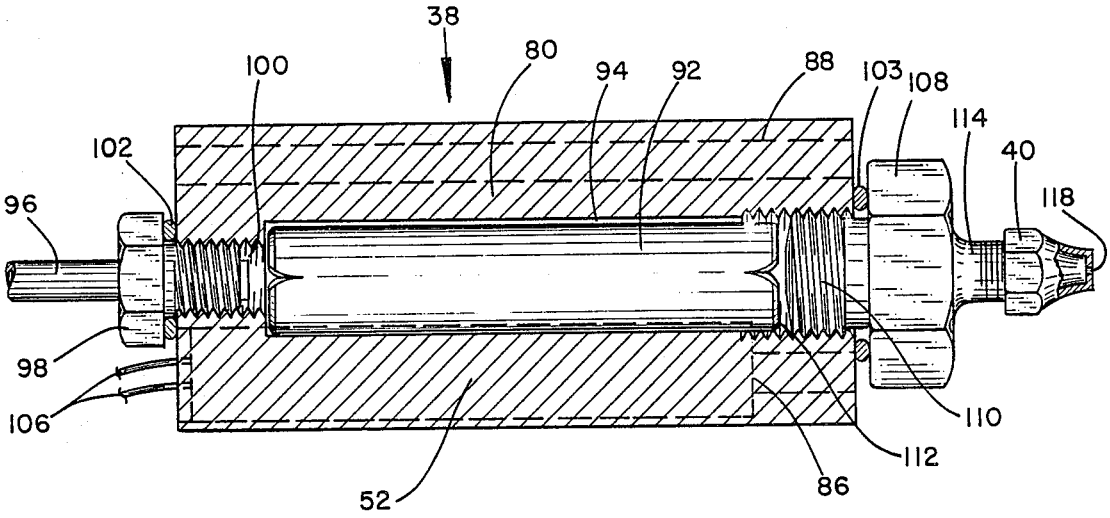
FIG. 4 is a side sectioned view of the vaporizer unit of the smoke-generating apparatus.
Figure 5:
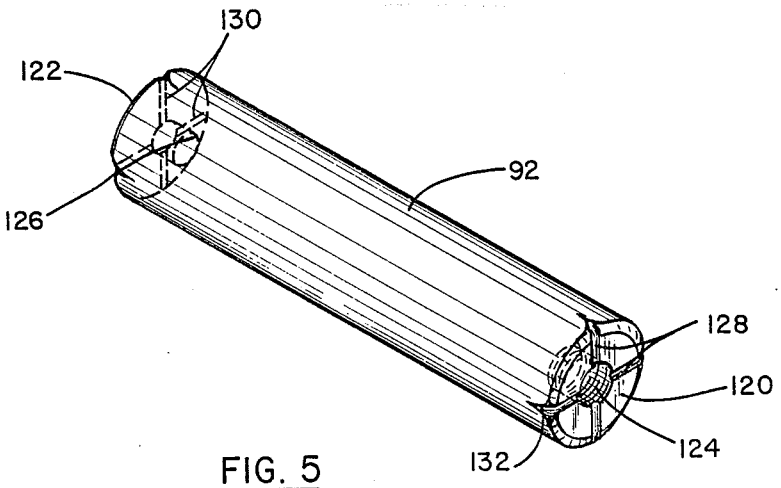
FIG. 5 is a perspective view of the vaporizer element used for mounting in the vaporizer unit.
Figure 6:
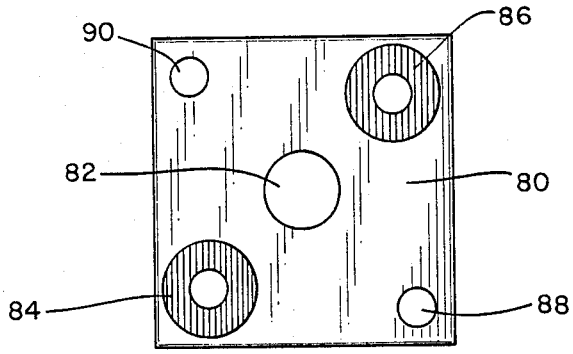
FIG. 6 is an end view of the vaporizer unit housing.

The entire smoke-generating apparatus as it is actually housed is depicted in FIG. 1. The liquid vaporizing unit which is housed on the interior of the unit shown in FIG. 1 and which forms the most important part of the smoke generator is shown in FIGS. 4–6. Referring first to FIG. 1, smoke-generating apparatus 1 has a sheet metal housing 2 in the form of a rectangular enclosure. The cover portion 4 is a generally inverted U-shaped member which fastens by means of sheet metal screws 5 to a base portion 16 onto which the various components of the unit are mounted. A wooden handle 12 is mounted on the cover portion of the housing by means of mounting brackets 8 and 10 which are welded to the housing. A rear panel portion 6 mounts various electrical features of the apparatus. The smoke exhaust nozzle 40 is mounted in a corresponding front panel portion of the housing.

A pressurized fluid-containing tank 18 is mounted on a platform 14 which is welded to the base. Suitable tanks are commercially available from Milwaukee Sprayer of Milwaukee, Wisconsin, or W. W. Grainger, No. 2Z8857. A common tire pressurizing valve or Shroeder valve 26 is used to pressurize the tank with air up to a maximum of about 200 psi, although pressures of 60–100 psi are adequate. A pressure relief valve 24 protects the tank against explosion in the event of excessive pressures. Fluid is released from the tank by means of a lever-operated valve 22 mounted above the handle 20 of the container. Smoke-generating liquid passes from the container into the housing through line 28 which is coupled to the tank by means of quick-disconnect fitting 30. A suitable quick-disconnect connection is available from Chester Paul as part No. 285-RF. Line 28 fastens to the housing by means of mounting bracket 27 and U-shaped clamp 29 which holds the line to the bracket. A needle valve 32 mounted on the base 16 is used to adjust the quantity of flow from the tank into the vaporizing unit. The balance of the system is mounted interior of the housing.

Various types of smoke-generating liquid are available for use in the apparatus of the invention, and the particular liquid to be used will be selected depending upon the smoke characteristics desired. Typical smoke-generating fluids may consist of a 50–50 mixture of USP grade mineral oil and odorless kerosene, No. 2 diesel fuel, polypropylene glycol, any U.S. Navy smoke oil, polyethylene glycol, and the like. In addition, the smoke-generating liquid can be used with water, pesticide, or a leak detecting chemical. Use of the vaporizer of the invention is particularly successful when used in conjunction with a pesticide, since the vaporizer unit completely vaporizes the pesticide into a dry, pervasive fog. Accordingly, the invention is not limited with respect to the particular smoke-generating fluid to be vaporized.

Figure 2:
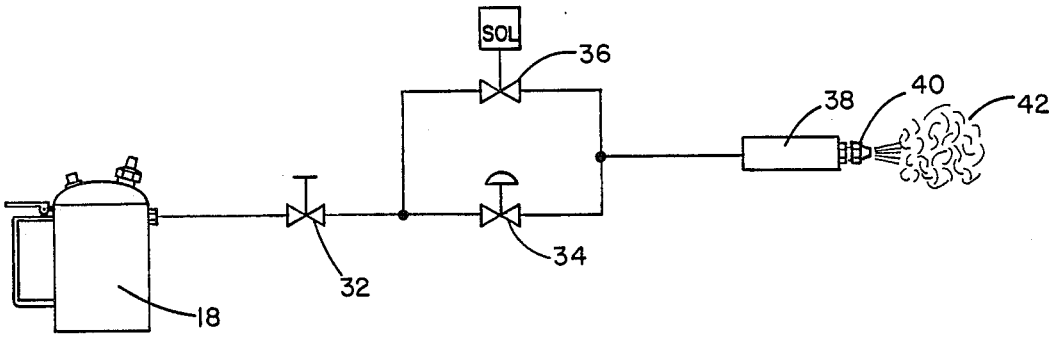
FIG. 2 is a schematic flow diagram for the smoke-generating liquid.

As shown in FIG. 2, smoke-generating liquid travels from the pressurized container 18 through needle valve 32 which is preset to provide a desirable flow rate of liquid into the vaporizer 38 depending upon the volume of smoke to be generated, the particular type of smoke-generating fluid being used, the tank pressure, and the resistance of flow through the lines. Fluid can be fed to the vaporizer unit 38 either through a thumb-operated valve 34 which mounts on top of the housing (see FIG. 1), or through a solenoid valve 36. The solenoid valve is remotely actuated as later described. The manual valve 34 may suitably be a Howell valve, No. MJV-2, with a thumb-operated button 35 which is Howell part No. 11916-2. The solenoid valve 36 is a special AC-DC operable unit manufactured by W. W. Grainger as part No. 7XO74. Fluid passes through valve 34 or valve 36 into vaporizing unit 38, wherein the smoke-generating liquid is vaporized and passes out of the unit through nozzle 40 as smoke 42. The conduit used to pass fluid from the holding tank to the vaporizer unit is standard ½" copper tubing. Valves 34 and 36 are simply on-off valves used to open and close the line to fluid flow; actual metering of the flow is effected by needle valve 32.

Figure 3:
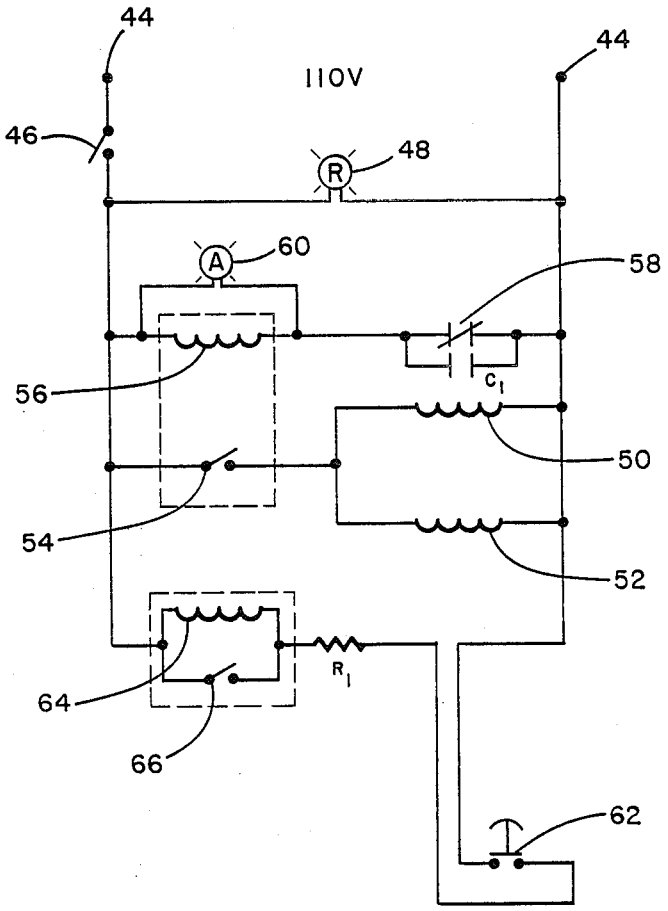
FIG. 3 is an electrical diagram therefor.

The electrical components of the invention are principally shown in FIGS. 1 and 3, the latter being a schematic diagram. A 110-volt power source 44, consisting of power cord 70 which connects to male plug 68 on the real panel of the apparatus, is controlled to the unit by a circuit-breaker on-off switch 46. A suitable commercially available switch is manufactured by Hienien as part No. 760. A circuit breaker is particularly desirable to prevent accidental connection of the unit to a 220-volt source; on a movie set, it is common to have power sources for both 110-volt and 220-volt power available at a plurality of locations on the set, and accidental connection of the unit to a 220-volt source would damage the unit and create potential danger.

Power passes through a relay switch 54 to a pair of heater elements 50 and 52 mounted in parallel. A suitable relay switch is a W. W. Grainger 35-amp relay with AC-DC contacts, part No. 6X599. The relay has mercury-wetted contacts to insure that the contacts do not stick. A thermostat 58, such as Pacific Thermal Sales part No. 16050-O, is mounted in series with the coil 56 of relay 54 to shut off power to the resistance heaters when the temperature in the vaporizer unit exceeds a pre-set level (about 900° F.). The thermostat resets and actuates switch 54 when the temperature decreases below a pre-set level. An amber light 60 mounted across the relay indicates to the user when the heating elements are actuated. A similar red light 48 mounted across the switch 46 indicates when power is being supplied to the unit. The red and amber neon pilot lights 48 and 60 are available from Caltronics as part Nos. PL-12A. A capacitor having a capacitance of 0.5 μf is mounted across the thermostat contacts to prevent arcing across the thermostat.

The bottom portion of the circuit diagram of FIG. 3 shows the connection of the electrical actuation for solenoid valve 36, which permits remote use of the smoke generator. A remote thumb-operated switch 62 is connected through $R_1$ to solenoid coil 64 closing switch 66 and opening valve 36. $R_1$ is a 200 ohm, 25-watt voltage dropping resistor that will enable the solenoid coil to operate on either AC or DC; the coil requires 160ma of current. As shown in FIG. 1, remote switch 62 is connected by electrical cord 72 and male plug 74 to a receptacle 76 on rear panel 6 of the housing.

The most important part of the smoke-generating apparatus of the invention is the vaporizing unit. The unit is shown in FIGS. 4–6. The vaporizing unit 38 comprises a solid copper block or base 80 fabricated from copper square stock, and having dimensions of about 2"×2"×4 ½". The block is quite heavy, weighing about 7.5 pounds. A plurality of longitudinal bores exist in the block as shown in FIG. 6. A central bore 82 forms vaporizing chamber 94 which contains vaporizing element 92. Diagonal bores 84 and 86 slideably house the resistance heating elements 50 and 52, and the smaller diagonal bores 88 and 90 are thermostat cavities. When mounted inside the housing, the heating block 80 is wrapped in an insulating fire-proof cloth (not shown).

A vaporizing element for a rod 92 is coaxially mounted in the heating and vaporizing chamber 94. The vaporizer rod is an elongate member fabricated from solid copper and having a cross-sectional geometric configuration corresponding to the cross-sectional configuration of the elongate vaporizing chamber walls. As shown in the drawings, the cross-sections of the vaporizing element and the chamber walls are preferably circular, although other configurations (hexagonal, octagonal, etc.) may be used. The most important design criteria for the vaporizing unit is a very high surface area/volume ratio along the path which must be traveled by the smoke-generating fluid within the vaporizing chamber. This requires relatively close tolerances between the vaporizing element and the chamber walls. For example, a specific embodiment of the smoke-generating apparatus has a vaporizing chamber having a 0.750" inside wall diameter, and a 0.738" vaporizing element outside diameter. In other words, the maximum clearance between the vaporizing element and the chamber walls is 0.012". Applicant has found that with a 0.750" ID chamber wall, the O.D. of the vaporizing element can be as low as 0.720 before the smoke becomes somewhat moist and of less desirable quality. While the precise configuration of the vaporizing chamber is difficult to accurately define, in order to provide instant and complete generation of a white, dry smoke of very small particle size (about 1 micron), it has been found that the material of construction of the vaporizing unit should have a high heat-transfer coefficient, thus enabling heat to travel rapidly from the heating element to the vaporizing chamber, and that the fluid contact a large heating surface area in passing through the unit. In the portion of the vaporizing unit in which the vaporizing element is mounted, the surface area/volume ratio of heating surface to fluid passageway should be at least 500, and more preferably at least 1,000, sq.in./cu.in. In the specific example of a 0.750" I.D. chamber and 0.738" O.D. element, the surface to volume ratio is about 1300.

Smoke-generating fluid enters the vaporizing unit through inlet tubing 96 at a pressure of 60–100 psi. The tubing 96 extends through a hollow plug fitting 98 and is soldered thereto by silver solder having a melting point of about 1650° F. The tubing extends axially into the threaded opening 100 in bore 82 of the vaporizing unit. A hollow exit fitting 108 has a threaded plug portion which engages female threads 112 in the opposite end of bore 82. Crush gaskets 102 and 103 fabricated from copper and having an asbestos core prevent leakage around the entrance and exit of the vaporizing unit at the high temperatures (about 875° F.) of operation of the unit. A nozzle 40 is mounted on a threaded nipple 114 at the forward portion of fitting 108 for discharge of smoke through an orifice 118 at the nozzle tip.

The orifice 118 in nozzle 40 is circular, having a diameter preferably from about 0.035" to about 0.080", and still more preferably about 0.060". Smaller orifice diameters may be used, but the volume of smoke producible through such a nozzle is generally undesirably small; orifice diameters of larger than about 0.080" tend to produce smoke which is somewhat wet. While orifice shapes other than circular may be used, generally the maximum cross-sectional area of such an orifice is about 0.005 sq.in. FIG. 4 also shows heater element 52 mounted in the heating block; heater wires 106 are Fiberglas insulated high-temperature wires to preclude damage to the wire by the high temperatures used in the vaporizer unit.

The particular configuration of the vaporizing element 92 is also important. As best seen in FIG. 5, the element is a solid cylindrical rod having opposing flat ends 120 and 122. A threaded bore 124 in the downstream end of the element permits easy removal of the element from the vaporizing chamber in the event that the chamber becomes encrusted with carbon from continued use. The element is removed by means of a threaded tool which engages bore 124, enabling it to be easily pulled outwardly after removing fitting 108. A similar non-threaded bore 126 exists in the upstream end of the element; this opening allows fluid to pass from the inlet tubing 96 into the forward end of the element for initial vaporization. A series of grooves 128 and 130 extend radially from central portions of the flat ends 120 and 122 of the heating element to the edge thereof, and are flared slightly and extend somewhat along the external surface of the cylinder. While four radial grooves are shown at each end of the element, a larger or smaller number of grooves may be used. These grooves direct the flow of fluid longitudinally along the cylinder and ensure that a constriction at either end of the element cannot occur. Since the element is loosely mounted in the vaporization chamber, when liquid is first inserted into the chamber, the pressure from initial vaporization drives the element forward; the grooves at the downstream end of the element ensure a free passage of fluid flow into the nozzle. The loose mounting of the cylinder in the chamber enables the cylinder to move slightly forwardly and backwardly (about 0.050"), thus helping to keep the unit clean by driving carbon off of the interior of the element. As indicated, the radial grooves provide channel means to ensure free flow of fluid.

Figure 7:
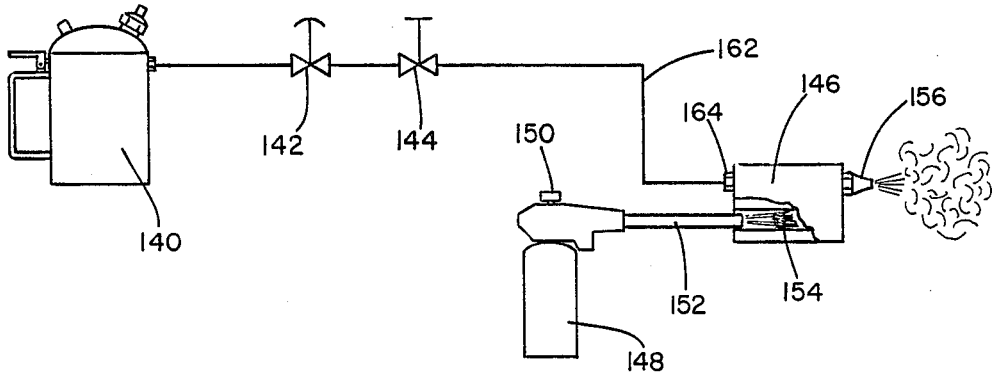
FIG. 7 is a schematic flow diagram of an alternate embodiment of the smoke-generating apparatus in which a liquefied gas torch is used as a source of heat for the unit.
Figure 8:
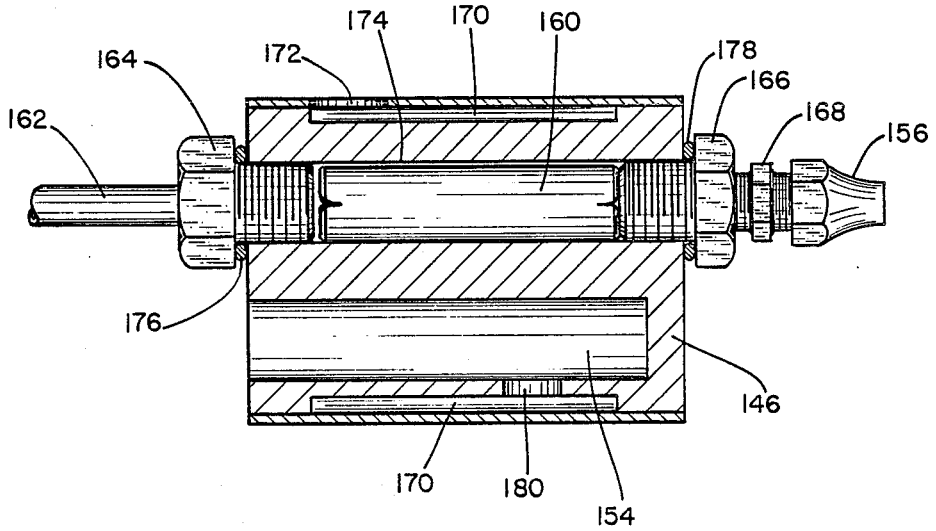
FIG. 8 is a side sectioned view of the vaporizer unit of the embodiment shown in FIG. 7.

FIGS. 7 and 8 sow an alternate embodiment of the smoke generator of the invention in which heat is supplied to the vaporizer unit by means of combustion gases from a gas torch. The liquid flow diagram for the embodiment is shown in FIG. 7. Smoke-generating liquid is pumped from pressurized tank 140 (similar to tank 18) through a manually-operated pushbutton valve 142 (similar to valve 34) and needle control valve 144 (similar to valve 32). Liquid passes through liquid inlet line 162 and fitting 164 into the vaporizer unit 146 in the same manner as described in the previous embodiment. Liquefied flammable gas is contained in cylinder 148; flow of liquefied gas is controlled through manually-operated valve 150. As valve 150 is opened, gas vaporizes and passes through barrel 152 and into the combustion chamber 154 of the vaporizer unit. The smoke-generating liquid is vaporized and exhausted through nozzle 156, which is the same nozzle as nozzle 40. Gas torches for use in this embodiment of the smoke-generating unit of the invention are commercially available; a Bernz-O-Matic Propane Fuel Torch model TX-9 is acceptable. Any type of combustible gas may be used to supply heat to the vaporizer unit; propane, butane, or mixtures thereof with acetylene are particularly useful. In the simplified unit shown in FIG. 7, a temperature gauge may be welded to an exterior wall of the unit and may be visually monitored to maintain the temperature at the correct level. While the external temperature is necessarily lower than the internal temperature of the unit, with a small amount of practice a user can correlate the external temperature with a proper operating condition. Typically, an external wall temperature of about 600° F. for a cylindrical copper block having a 2" outside diameter has been found to correspond to an internal operating temperature of 850°-900° F.

Construction of the vaporizer unit is best seen in FIG. 8. Vaporizing element 160, which is similar in construction to element 92, is mounted in vaporizing chamber 174. Dimensions of the chamber and the element are the same as for the embodiment of the vaporizing unit shown in FIGS. 1-6. The solid copper block 146 has the interior chamber 174 located at slightly above the axis of the cylindrical block. Torch barrel-receiving chamber 154 is a bore located slightly below the center axis. An annular passageway 170 extends around the entire external central portion of the vaporizer unit, and acts as a conduit for burner exhaust gases which pass from burner chamber 154 through opening 180 into the annular passageway 170, around the entire periphery of the vaporizing unit, and out to the atmosphere through an opening 172 in a top portion of the vaporizing unit. Flow of hot combustion gases around the exterior of the unit heats the entire copper block 154 from an outside portion thereof, thereby providing uniform heating into the vaporizing chamber. The vaporizing chamber is sealed against leakage by crush gaskets 176 and 178 between the vaporizing unit and fittings 164 and 166, respectively. Smoke generated in the vaporizing chamber passes through axial bores in fitting 166 and threaded nipple 168, and out to the atmosphere through an orifice in nozzle 156.

Because of the high temperatures inside the vaporizing chamber of 800°-900° F., some carbonization in the unit occurs and it has been found necessary to clean the interior after about 10 hours of usage. It is has also been found that the addition of certain chemicals, such as diesel fuel additives used to keep injectors clean such as Gumout, Redline, and STP, to the smoke-generating liquid helps to keep the carbon soft and facilitate cleaning.

Many modifications and additions to the apparatus of the invention will be immediately apparent to those skilled in the art. Accordingly, the foregoing description of preferred embodiments of the invention should be viewed as illustrative rather than definitive. The invention should be considered limited only by the following claims.

I claim:

1. Portable smoke-generating apparatus comprises a housing, a pressurized source of smoke-generating liquid, vaporizing means comprising a solid base member having an elongate interior vaporizing chamber formed by chamber walls, an elongate, solid vaporizing member mounted in the vaporizing chamber and having a cross-sectional geometric configuration corresponding to the cross-sectional configuration of the vaporizing chamber, exterior walls of the vaporizing member and the chamber walls defining a fluid passageway in the vaporizing means, said exterior walls and said chamber walls consisting essentially of smooth surfaces, said chamber having a length slightly greater than the length of the vaporizing member such that the vaporizing member is longitudinally movable within the chamber, heating means to maintain the temperature of the vaporizing chamber at a level sufficient to vaporize the smoke-generating liquid, inlet means to permit the passage of smoke-generating liquid under pressure into the vaporizing chamber, smoke outlet means comprising a nozzle having an orifice through which smoke exits from the vaporizing chamber, and conduit means for passing smoke-generating liquid from the pressurized source to the vaporizing chamber.

2. The apparatus of claim 1 wherein the solid base member comprises a solid metal block having an opening therein to receive the heating means.

3. The apparatus of claim 1 wherein the vaporizing means comprises a solid metal block having an opening therein for receiving electrical resistance heating means, and electrical resistance heating means mounted in said opening.

4. The apparatus of claim 1 wherein the vaporizing member comprises a solid metal bar, and the cross-sectional clearance between external walls of the bar and the chamber walls is less than about 0.03".

5. The apparatus of claim 1 wherein the cross-sectional surface area/volume ratio in the vaporizing chamber is at least 500 sq.in./cu.in.

6. The apparatus of claim 1 wherein the cross-sectional surface area/volume ratio in the vaporizing chamber is at least 1,000 sq.in./cu.in.

7. The apparatus of claim 1 wherein the vaporizing member comprises a solid metal bar having a threaded axial bore in an end thereof.

8. The apparatus of claim 1 wherein the vaporizing member comprises a solid metal bar having first and second opposing end surfaces, each end surface having a plurality of spaced radial grooves therein.

9. The apparatus of claim 1 also comprising first valve means in the conduit means for adjusting the flow of smoke-generating liquid from the pressurized source, and second valve means manually operable to control the flow of smoke-generating liquid to the vaporizing chamber.

10. The apparatus of claim 9 also comprising third valve means mounted in the conduit means for controlling the flow of smoke-generating liquid to the vaporizing chamber, said third valve means being electrically actuated, said apparatus also comprising remote actuating means for operating said third valve means from a location remote from the housing.

11. The apparatus of claim 1 wherein the vaporizing chamber and the vaporizing member have substantially circular cross-sectional configurations.

12. The apparatus of claim 11 wherein the diameter of the vaporizing chamber is greater than the diameter of the vaporizing member by not more that 0.030".

13. The apparatus of claim 1 also comprising nozzle means connected to the vaporizing means, and an orifice in the nozzle means having a diameter of from about 0.035" to about 0.080".

14. The apparatus of claim 1 wherein the heating means comprises a source of combustible liquefied gas, a cavity in the solid base member for receiving hot combustion gases, gas conduit means for conducting combustible gas from the combustible gas source to the cavity, an annular passageway in said block for conducting combustion gases away from the cavity, and exit means for exhausting combustion gases from the annular chamber.

15. Portable smoke-generating apparatus comprises a housing, pressurized source of smoke-generating liquid, vaporizing means comprising a solid metallic block elongate cylindrical interior vaporizing chamber formed by chamber walls, an elongate, solid cylindrical metallic vaporizing member mounted in the vaporizing chamber, exterior walls of the vaporizing member and the chamber walls defining therebetween a fluid passageway in the vaporizing means, the surface area/volume ratio along said fluid passageway being at least 500 sq.in./cu.in., said exterior walls and said chamber walls consisting essentially of smooth surfaces, said chamber having a length slightly greater than the length of the vaporizing member such that the vaporizing member is longitudinally movable within the chamber, heating means to maintain the temperature of the vaporizing chamber at a level sufficient to vaporize the smoke-generating liquid, and fluid inlet means to the vaporizing chamber and smoke outlet means at a downstream portion of the vaporizing chamber.

* * * * *